United States Patent [19]

Dye

[11] 4,141,940

[45] Feb. 27, 1979

[54] CARBURETOR FUEL FLOW CONTROL

[75] Inventor: Silas O. Dye, Highland, Ill.

[73] Assignee: ACF Industries, Incorporated, New York, N.Y.

[21] Appl. No.: 864,698

[22] Filed: Dec. 27, 1977

[51] Int. Cl.[2] ..... F02M 7/22

[52] U.S. Cl. ..... 261/23 A; 261/44 B; 261/46; 261/DIG. 39

[58] Field of Search ..... 261/46, 48, DIG. 58, 261/23 A, DIG. 39, 44 B

[56] References Cited

U.S. PATENT DOCUMENTS

| | | | |
|---|---|---|---|
| 1,195,113 | 8/1916 | Smith | 261/48 |
| 1,373,550 | 4/1921 | Chandler | 261/46 |
| 1,590,059 | 6/1926 | Reents et al. | 261/48 |
| 1,908,609 | 5/1933 | Jargstorff | 261/46 |
| 1,929,234 | 10/1933 | Anderson | 261/62 |
| 1,946,284 | 2/1934 | Huber | 261/48 |
| 1,983,255 | 12/1934 | Wahlmark | 261/46 |
| 2,225,261 | 12/1940 | Jorgensen | 261/39 D |
| 3,802,671 | 4/1974 | Klutho | 261/DIG. 56 |
| 3,829,069 | 8/1974 | Hailstone | 261/44 B |

*Primary Examiner*—Tim R. Miles

[57] ABSTRACT

A staged carburetor comprises a carburetor body having an inner induction passage with a venturi therewithin and an outer induction passage encircling the inner induction passage. A fuel circuit has an outlet at the venturi. A fuel metering rod extends transversely of the induction passages and has a variable diameter end portion projecting into the outlet. The metering rod moves relative to the outlet to vary the quantity of fuel delivered and has an enlarged diameter section intermediate its length which further reduces the cross-sectional area of the inner induction passage at the venturi and increases the pressure drop created thereat. An air valve positioned in the outer induction passage normally closes the passage whereby air is initially drawn into the engine only through the inner induction passage. Increased demand for air results in an opening force being exerted on the air valve to open it so air is drawn into the engine through both induction passages. The air valve is linked to the metering rod to move it relative to the outlet as the air valve opens and change the quantity of fuel drawn into the inner induction passage. Atmospheric air is bled into the inner induction passage to modulate the pressure drop created and control the air-fuel ratio of the mixture produced in the induction passages.

15 Claims, 7 Drawing Figures

CARBURETOR FUEL FLOW CONTROL

BACKGROUND OF THE INVENTION

This invention relates to carburetors and more particularly to a staged-type carburetor whose fuel metering signal is modulated to control the air-fuel ratio of the mixture produced in the carburetor.

Staged-type carburetors are designed to have performance characteristics approximating those of a non-staged type or conventional carburetor having more barrels or induction passages than the staged carburetor. Thus, for example, the operating characteristics of a staged two-barrel carburetor should approximate those of a corresponding non-staged four-barrel carburetor. In one design for a staged two-barrel carburetor, the pressure drop or fuel metering signal created at a venturi in the carburetor's induction passage was experimentally found to be approximately four times that normally created in a non-staged carburetor. Since the flow rate of fuel through a carburetor's fuel circuit is proportional to the pressure drop created in the carburetor's induction passage, much more fuel is delivered to the induction passage than is required for proper engine operation and an air-fuel mixture is produced in the induction passage which is too rich.

SUMMARY OF THE INVENTION

Among the several objects of the present invention may be noted the provision of a carburetor in which the fuel metering signal created at a venturi in an induction passage of the carburetor is much greater than that created in a conventional carburetor; the provision of such a carburetor in which the fuel metering signal is desensitized so the signal more nearly corresponds to that produced in a conventional carburetor; the provision of such a carburetor in which the metering signal is desensitized only during a portion of the range of carburetor operation; and the provision of such a carburetor which is a staged carburetor and the desensitization of the metering signal is produced only during the non-staged portion of carburetor operation.

Briefly, a staged carburetor of the present invention is for an internal combustion engine and comprises a carburetor body in which at least one pair of induction passages is formed for air to be drawn into the engine, the pair of induction passages including an inner induction passage having a venturi therewithin and an outer induction passage encircling the inner induction passage. A throttle valve is positioned at the outlet of the pair of induction passages and is movable between a closed and an open position to control the flow of air through the induction passages. Fuel is delivered to the inner induction passage through a fuel circuit having an outlet at the venturi. A fuel metering rod extends transversely of the induction passages and has a variable diameter end portion projecting into the fuel circuit outlet. The metering rod is movable relative to the outlet to vary the quantity of fuel delivered and the metering rod has an enlarged diameter section intermediate its length which further reduces the cross-sectional area of the inner induction passage at the venturi and increases the pressure drop created thereat. An air valve is positioned in the outer induction passage and normally closes the passage whereby air is initially drawn into the engine only through the inner induction passage. An increased demand for air by the engine results in an opening force being exerted on the air valve to open it so air is drawn into the engine through both induction passages. The air valve is linked to the metering rod to move the metering rod relative to the fuel circuit outlet as the air valve opens thereby to change the quantity of fuel delivered to the inner induction passage. The quantity of fuel delivered to the inner induction passage at any one time mixes with air flowing through the pair of induction passages at that time to produce an air-fuel mixture combusted in the engine. Atmospheric air is bled into the inner induction passage at the venturi to modulate the pressure drop created thereat and control the air-fuel ratio of the mixture produced in the induction passages. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
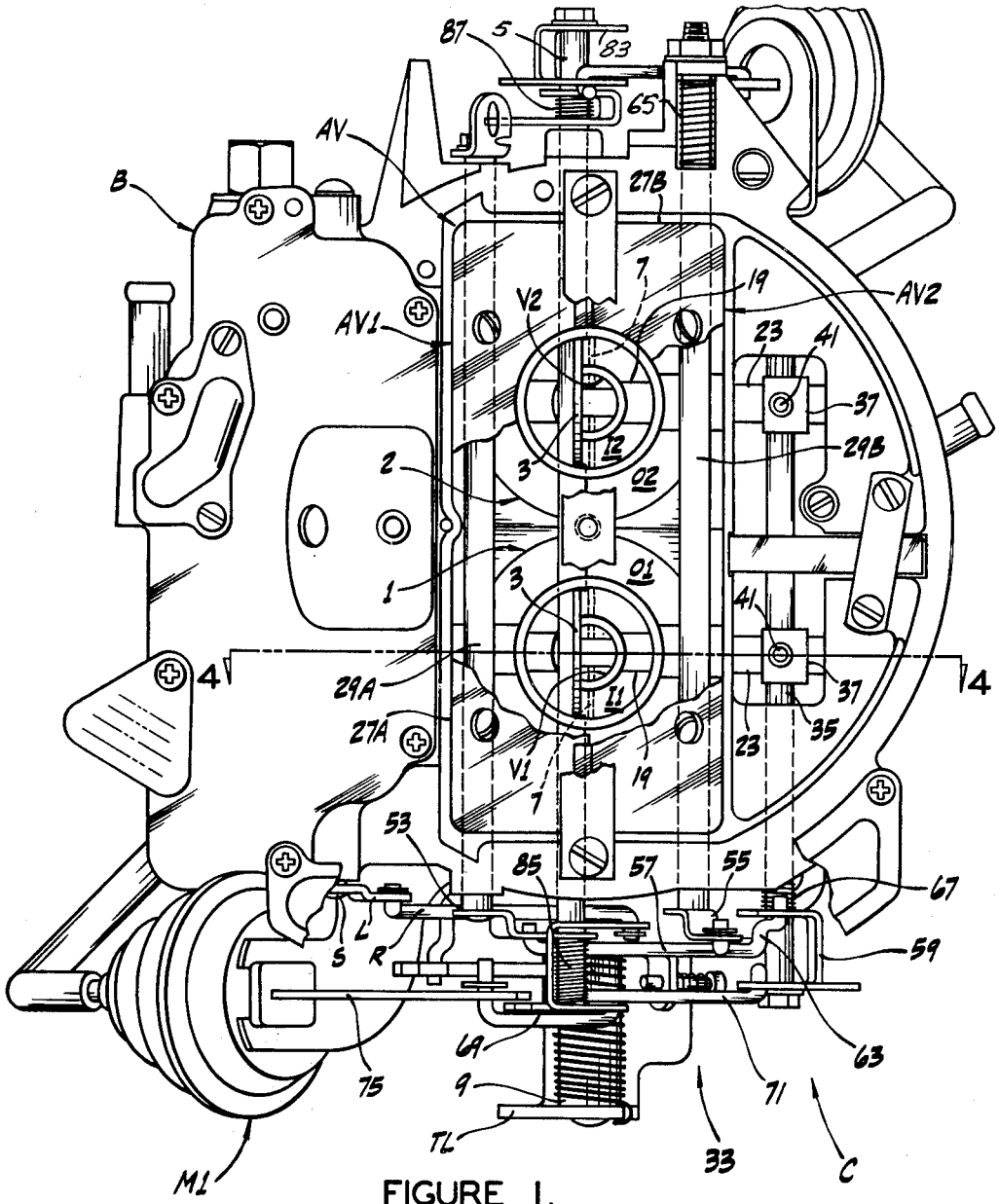
FIG. 1 is a top plan view of a carburetor of the present invention.

Referring now to the drawings, a staged carburetor for an internal combustion engine (not shown) is indicated generally C and has a body B and a flange F for mounting the carburetor on the intake manifold of the engine. Body B and flange F are of a lightweight material such as aluminum. A first pair of induction passages, generally indicated 1, is formed in the carburetor body, pair 1 including an inner induction passage I1 having a venturi V1 therewithin and an outer induction passage O1 which encircles the inner induction passage. Preferably, a second pair of induction passages, generally indicated C, is formed in the carburetor body. This second pair of passages includes an inner induction passage I2 having a venturi V2 therewithin and an outer induction passage O2 encircling the inner induction passage. As best shown in FIG. 1, passages I1 and O1 are concentric as are passages I2 and O2. When the carburetor is installed on an engine's intake manifold, pairs 1 and 2 of induction passages are aligned with the respective intake ports of the manifold.

A choke valve 3 is positioned at the inlet to each inner induction passage and the choke valves are commonly mounted on a rotatable choke shaft 5. The choke valves are movable between a closed and an open position as will be described hereinafter. The choke valves are shown in their fully open position in FIG. 1 and one of the choke valves is shown in a closed position in FIG. 4. A throttle valve 7 is positioned at the outlet of each pair of induction passages. The throttle valves are commonly mounted on a rotatable throttle shaft 9 and the throttle valves are movable between a closed and an open position; the fully open position of the throttle valves being indicated in FIG. 1.

Figure 4:
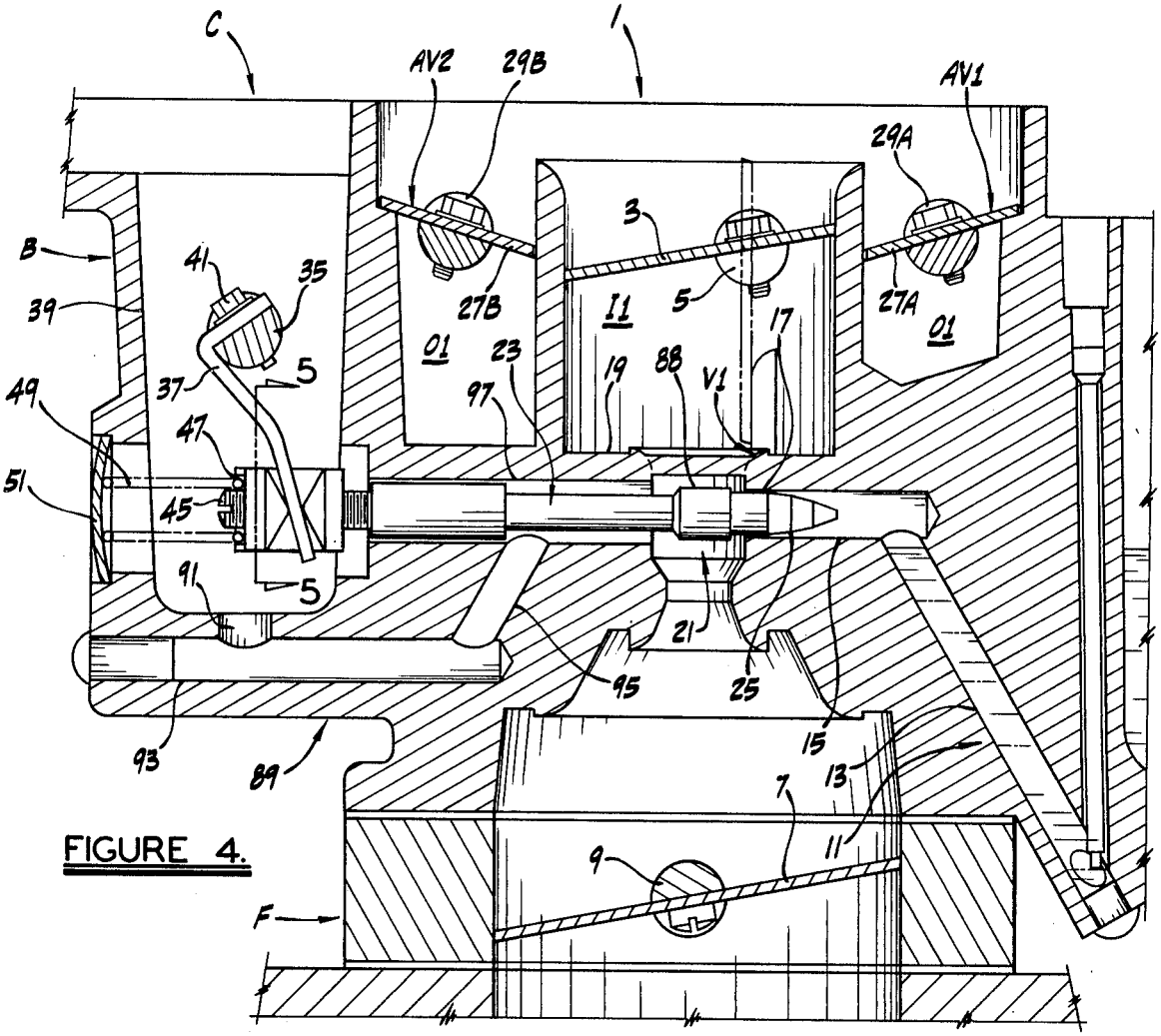
FIG. 4 is a sectional view of the carburetor taken along line 4—4 in FIG. 1.

Fuel is delivered from a fuel bowl (not shown) of the carburetor to the inner induction passage of each pair of induction passages through respective fuel circuits 11, one of which is shown in FIG. 4. Each fuel circuit includes an upwardly sloping fuel passage 13 and a horizontal fuel passage 15 which connects with passage 13 at the upper end of the passage. Each passage 15 has an outlet 17 at the venturi in the respective inner induction passages. Fuel is admitted into the lower end of each passage 13 through respective openings in the bottom of the fuel bowl. A pair of tapered metering rods (not shown) are vertically disposed in the fuel bowl with the tapered end of each metering rod projecting into one of the openings. This is as is well known in the art. As is further well known in the art, the metering rods are suspended from hangar assemblies (not shown) and are raised and lowered relative to the respective openings by the rotation of a shaft S (see FIGS. 1 and 2). A lever L is rigidly mounted on one end of shaft S and the lever is connected to a throttle lever TL via a connecting rod or link R. The operation of this arrangement is well known in the art and is such that as throttle shaft 9 rotates in the direction to open throttle valves 7, shaft S is rotated in the direction to withdraw the tapered ends of the metering rods in the fuel bowl from their respective openings so more fuel flows from the fuel bowl into the inlet of each passage 13. As throttle shaft 9 rotates in the throttle valve closing direction, shaft S is rotated to insert the tapered end of the metering rods into their respective openings so less fuel is admitted into each passage 13.

A support strut 19 (FIGS. 1 and 4) extends transversely of each pair of induction passages to support each venturi assembly. Each strut is hollow and is open as indicated at 21. A metering rod 23 extends transversely of each induction passage and is positioned within strut 19. Each metering rod is slidable within its respective strut and has a variable diameter end portion 25 projecting into the respective outlets of respective fuel circuits 11. Further, each metering rod is movable relative to its associated outlet 17 to vary the quantity of fuel delivered to each pair of induction passages. As shown in FIG. 4, metering rod 23 is movable in a horizontal plane relative to outlet 17.

Figure 6:
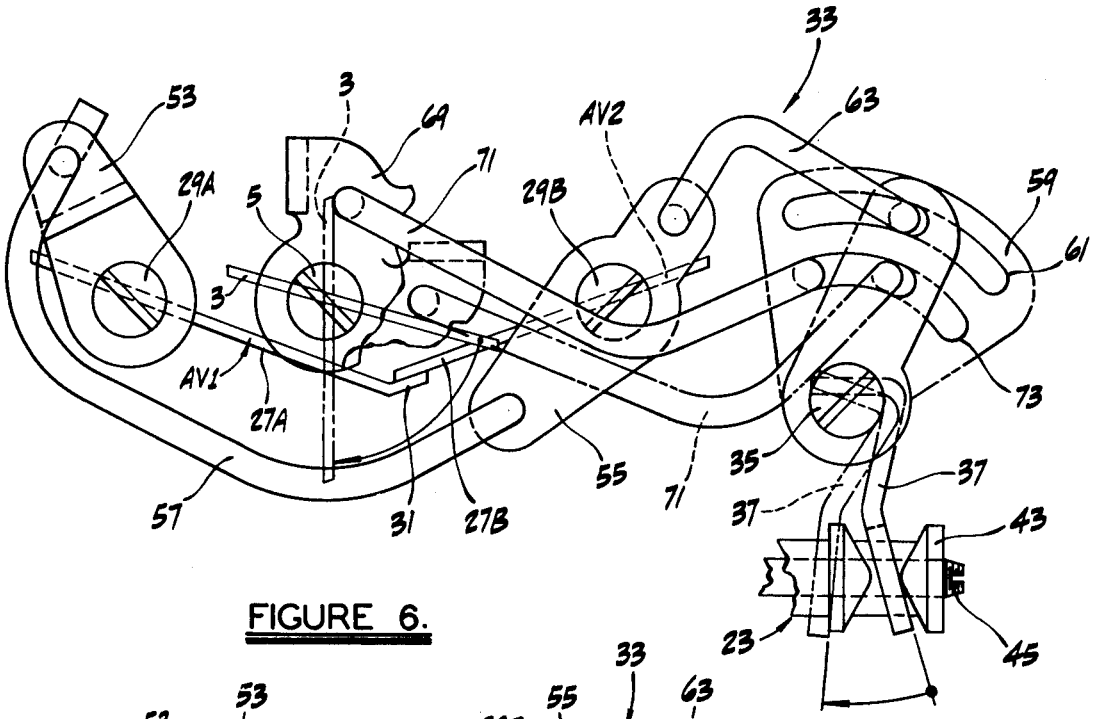
FIGS. 6 and 7 are side elevational views of a linkage mechanism of the carburetor illustrating the working of the linkage for various stages of carburetor operation.

An air valve, generally indicated AV, is positioned in the outer induction passage of each pair of induction passages. The air valve is a split valve having a first section AV1 and a second section AV2 each respectively closing a portion of the outer induction passages. Specifically, each air valve section is a rectangular plate, 27A and 27B respectively, contoured to fit around a portion of the inner induction passage of each pair of induction passages. Each plate is mounted on a rotatable shaft, 29A and 29B respectively, and closes approximately one-half of the area of the outer induction passages. As shown in FIG. 6, plate 27A has an outwardly extending lip 31 at its lower end; this lip acting as a seat for plate 27B of the air valve. Air valve AV normally closes the outer induction passage of each pair of induction passages so air is initially drawn into the engine on which the carburetor is mounted only through each inner induction passage. However, an increasing flow of air into the carburetor, as occurs when the engine is accelerated or experiences an increasing load, exerts a force on the air valve, i.e. an increasing air pressure on the outer surface of plates 27A and 27B, which opens the air valve so air is drawn into the engine through both induction passages of each pair.

Figure 5:
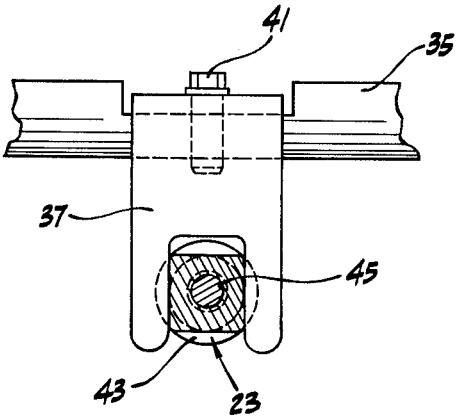
FIG. 5 is a sectional view of a metering rod assembly taken along line 5—5 in FIG. 4.

Air valve AV is linked to metering rods 23 via a linking means, generally indicated 33, to simultaneously move each metering rod relative to its associated fuel circuit outlet as the air valve opens or closes thereby to change the quantity of fuel delivered to each pair of induction passages. The linking means comprises a rotatable counter shaft 35 and a pair of levers 37 carried by the shaft. As shown in FIG. 4, a cavity 39 is formed in body B of the carburetor forward of the induction passages. The cavity extends down to a level somewhat below that of the metering rods. Counter shaft 35 extends transversely of this cavity in a perpendicular relationship to metering rods 23. Levers 37 are attached to shaft 35 by screws 41 and project downwardly from the shaft to contact the metering rods. The depending end of the levers is forked as shown in FIG. 5. Each metering rod has a cap 43 fitted over its back end and the cap has recesses in its sides. The forked end of the levers are received in these recesses so the levers straddle the metering rods. Each metering rod 23 is axially bored to receive an adjustment screw 45 to adjust the position of the metering rods relative to their associated outlets and the leanness or richness of the mixture produced. Cap 43 has an annular recess 47 in rearward face and a bias spring 49 seats against cap 43 and a plug 51 which is fitted into an in body B immediately behind the back end of each metering rod. Each spring 49 biases its associated metering rod in a forward direction to insert the tapered end of the metering rods into their respective fuel circuit outlets 17.

A fixed lever 53 is rigidly mounted on one end of shaft 29A and a second fixed lever 55 is rigidly mounted on the corresponding end of shaft 29B. Lever 53 is an elongate lever secured to shaft 29A at one end; while lever 55 is a center pivot lever. A connecting rod 57 interconnects levers 53 and 55 to form a solid connection between the two; one end of rod 57 being attached to the free end of lever 53 and the other end of the rod being attached to one end of lever 55. With this solid connection, movement of one of the air valve sections produces a simultaneous corresponding opening movement of the other air valve section. A third fixed lever 59 is rigidly mounted on the end of shaft 35 corresponding to the ends of shafts 29A and 29B on which levers 53 and 55 are mounted. Lever 59 has a lost motion slot 61 and a connecting rod 63 has one end captured in the lost motion slot. The other end of rod 63 is attached to the end of lever 55 opposite the end to which rod 57 is attached. A coil spring 65 is secured to the end of shaft 29B opposite lever 55 and biases the shaft in a direction to close air valve section 29B (a clockwise direction as viewed in FIGS. 2, 6 and 7). Further, a coil spring 67 is secured on shaft 35 inwardly of lever 59. This spring biases the shaft for rotation in the direction to insert the tapered ends of the metering rods into their respective fuel circuit outlets (also a clockwise direction as viewed in FIGS. 2, 6 and 7).

A choke lever 69 is attached to the end of shaft 5 corresponding to the ends of shafts 29A, 29B and 35 on which the aforesaid fixed levers are mounted. A connecting rod 71 interconnects the choke lever with the fixed lever 59 which has a second lost motion slot 73 in which one end of rod 71 is captured. A vacuum motor M1 has a movable stem 75 projecting therefrom and the stem has a lost motion slot 77 at its outward end. Lever 69 has a lost motion slot 79 and a connecting rod 81 has its ends respectively captured in slots 77 and 79. A lever 83 is rigidly mounted on the other end of choke shaft 5 and is connected to a temperature unit (not shown). The temperature unit operates, as is well known in the art, to exert a closing force on the choke valves, this force lessening as engine temperature increases. Coil springs 85 and 87 are positioned on respective ends of shaft 5, spring 85 being inward of lever 69 on the one end of the shaft and spring 87 being inward of lever 83 on the other end of the shaft. Both springs bias the choke shaft in the direction to open choke valves 3.

Figure 2:
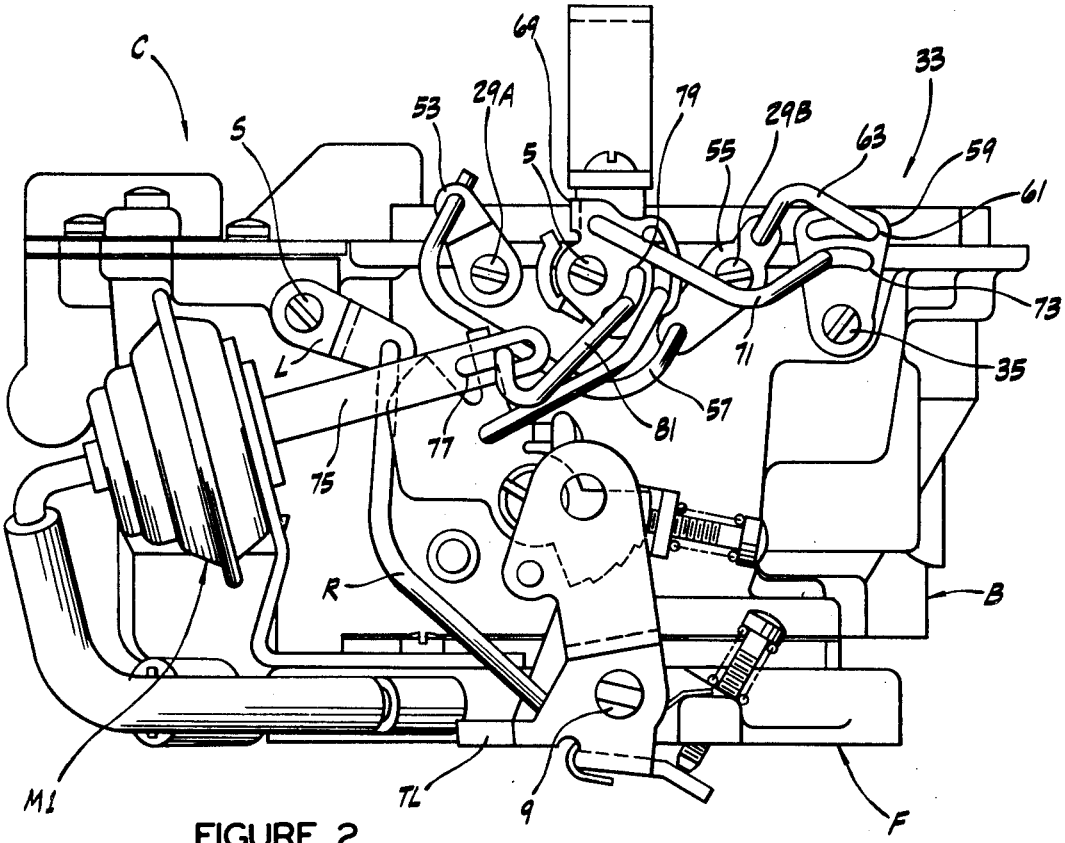
FIGS. 2 and 3 are side elevational views of the carburetor of FIG. 1.
Figure 3:
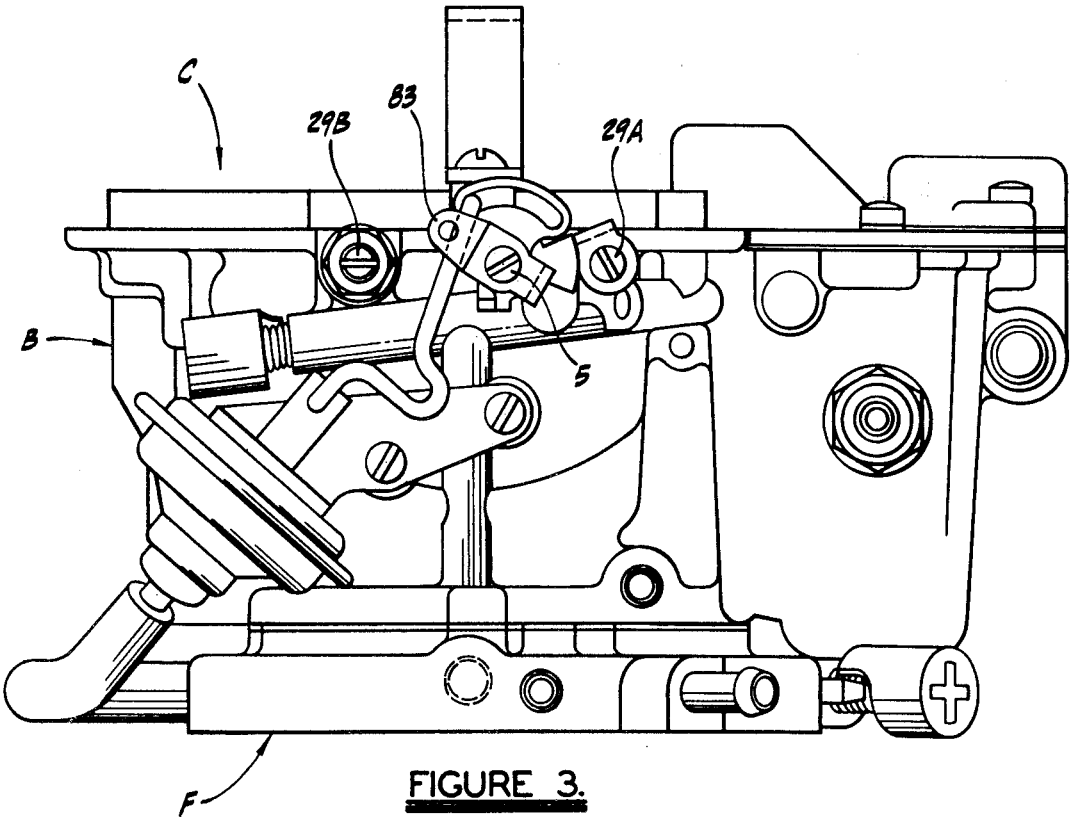

Referring to FIGS. 2, 3 and 6, when the engine on which carburetor C is installed is cold, both choke valves 3 are in the solid line position shown in FIG. 6, i.e. in a closed position closing the inlet of both inner induction passages I1 and I2. Lever 69 is at the position shown in FIG. 2 (which corresponds to the solid line position of the lever in FIG. 6). Connecting rod 71 exerts a counterclockwise rotative force on shaft 35 when the choke valves are closed and levers 37 are at their solid line position in FIG. 6, at which position their associated metering rods are moved to the right to withdraw the tapered ends of the rods from their associated fuel circuit outlets 17. With the tapered ends of the metering rods withdrawn from the fuel circuit outlets, a larger area is provided at each outlet for fuel to be drawn into the inner induction passages during cranking of the engine. This insures that the air-fuel mixture produced in carburetor C and combusted in the engine is sufficiently rich to start the engine. When the engine starts, vacuum motor M1 is exposed to manifold vacuum and stem 75 is pulled to the left as viewed in FIG. 2. This results in a clockwise rotative force being exerted on lever 69 and choke shaft 5 and the shaft rotates clockwise to move the choke valves to an initially open or choke break position. The opening force exerted on the choke shaft by vacuum motor M1 is opposed by the choke valve closing force exerted on the other end of the choke shaft by the temperature unit. As the engine warms up, the closing force produced by the temperature unit gradually lessens and the choke valves move to their fully open position (the broken line position shown in FIG. 6). As the choke shaft rotates in the choke valve opening direction, connecting rod 71 moves from its extreme left position in lost motion slot 73 of lever 59 to a more central position (the broken line position of the connecting rod in FIG. 6). As this occurs, shaft 35 is urged in a clockwise direction of rotation and levers 37 are moved to their broken line position in FIG. 6 and force their associated metering rods 23 to the left as indicated by the arrow. The tapered ends of the metering rods are inserted into their associated fuel circuit outlets 17 to decrease the amount of fuel drawn into the inner induction passage of each pair of passages. As a result, the air-fuel mixture supplied to the engine is leaned out to provide the proper mixture for efficient engine operation and to help reduce emissions produced by the engine.

As the engine on which carburetor C is installed is operated throughout its range, the amount of air drawn into the carburetor is controlled by the degree to which throttle valves 7 are open. As more air is drawn into the carburetor, the air pressure on the upper surface of plates 27A and 27B of the air valve sections increases until the air valve is forced open. This opening force is, for example, 3 pounds per square inch (psi) on one type of V-8 automotive engine. Under normal driving conditions, throttle valves 7 are open approximately 25°–30° when this occurs. It will be understood that the force required to open the air valve may differ for different sizes and types of engines on which carburetor C is installed.

Figure 7:
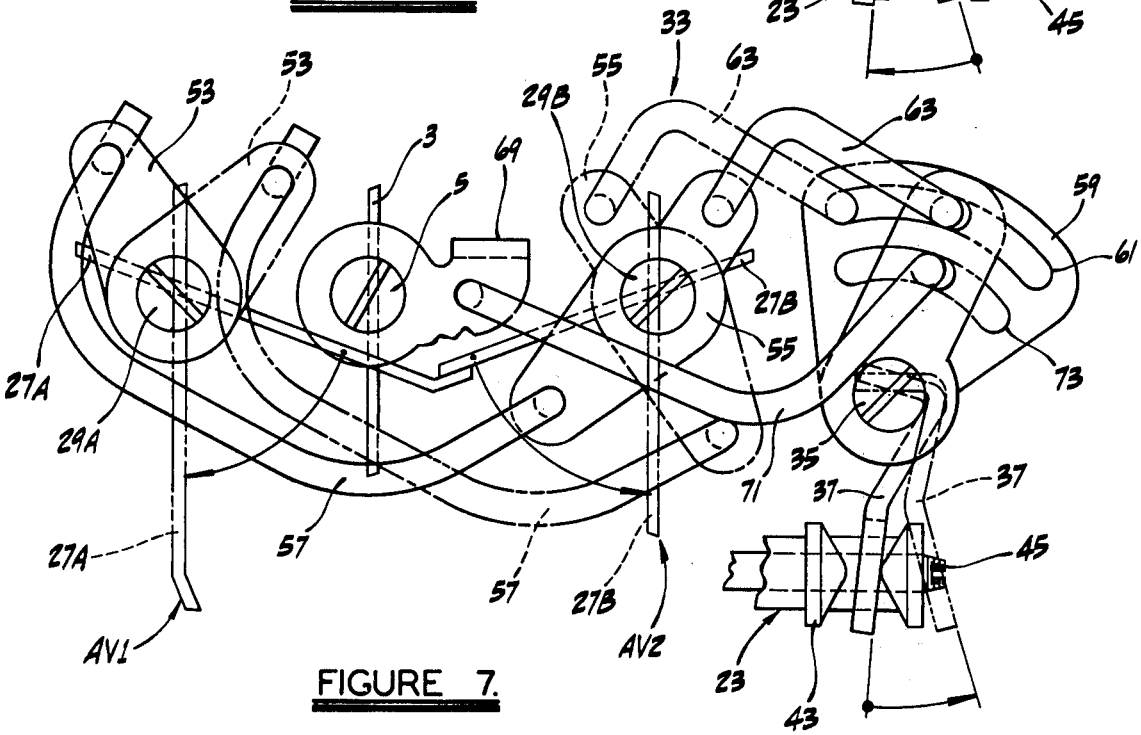

In any event, when the force exerted on air valve AV exceeds the minimum needed to open the valve, air valve section AV1 rotates in a clockwise direction as viewed in FIG. 7 and air valve section AV2 rotates in a counterclockwise direction as viewed in the figure. Because the shafts on which the air valve sections are mounted are interconnected, opening movement of one of the sections produces a simultaneous and corresponding opening movement of the other air valve section. As air valve section AV2 opens, lever 55 moves in a counterclockwise direction from its solid to its broken line position in FIG. 7. Connecting rod 63 moves from its centered position in slot 61 of lever 59 as this occurs and when it reaches the left end of the slot exerts a counterclockwise rotative force on counter shaft 35 to move metering rods 23 to the right as indicated by the arrow in FIG. 7. Thus, slot 61 comprises means for delaying the movement of the metering rods relative to their associated fuel circuit outlets until the air valve has partially opened. This movement of the metering rods withdraws their tapered ends from fuel circuit outlets 17.

Prior to the opening of air valve AV and the counterclockwise rotation of shaft 35, the position of metering rods 23 relative to their associated fuel circuit outlets is unchanged and the amount of fuel delivered to the inner induction passage of each pair of passages is controlled by the movement of shaft S in response to the movement of throttle lever TL as previously discussed. Now, however, as increased engine loads are experienced, the withdrawal of the metering rods from the fuel circuit outlets permits more fuel to be admitted into each inner induction passage to mix with the air now flowing through both the inner and outer induction passage of each pair of induction passages. As air valve AV increasingly opens (as both air valve sections move from their solid to their broken lines positions in FIG. 7), the metering rods move further to the right as viewed in the figure and an increasingly smaller diameter portion of the tapered end of each rod is in its associated fuel circuit outlet. Thus, more fuel is supplied to each pair of induction passages to increasingly enrich the air-fuel mixture supplied to the engine. As engine load decreases, less air is drawn into carburetor C and air valve AV begins to close. Air valve section AV1 moves counterclockwise from its broken line to its solid line position in FIG. 7 as the valve closes and section AV2 moves in a clockwise closing direction. Lever 55 moves clockwise with section AV2 as it closes as does lever 59. Shaft 35 is rotated clockwise and metering rods 23 are moved to the left (as viewed in FIG. 7) by levers 37. This movement inserts the tapered ends of the metering rods into their respective fuel circuit outlets and the amount of fuel delivered to each inner induction passage decreases. When the air valve is again closed, the metering rods have returned to their position relative to their associated fuel circuit outlets which existed prior to the air valve opening.

Referring again to FIG. 4, each metering rod has an enlarged diameter section 88 intermediate its length. This enlarged diameter section is in the flow path through the inner induction passage of each pair of induction passages. The enlarged diameter section therefore further reduces the cross-sectional area of the inner induction passage at each venturi and increases the pressure drop or fuel metering signal present at each fuel circuit outlet.

Means generally designated 89 permits atmospheric air to be introduced into the respective inner induction passages, at their respective venturis, to modulate the pressure drop created at the venturi, thus to desensitize the fuel metering signals and control the air-fuel ratio of the mixture produced in the induction passages. An air passage 91 extends downwardly from the bottom of cavity 39 and intersects a horizontal air passage 93. At the inner end of passage 93 is an upwardly sloping air passage 95. This passage intersects an air passage 97 in which metering rod 23 is positioned. Passage 97 in cylindrical and metering rod 23 is axially aligned in the air passage. Further, enlarged diameter section 88 of the metering rod is the same diameter as passage 97. It will be understood that the other side of carburetor C is configured in the same manner as the side shown in FIG. 4. As is well known in the art, the flow rate of fuel through each fuel circuit 11 is proportional to the pressure drop or metering signal created at the venturi, i.e. the greater the pressure drop (the stronger the metering signal) the greater the rate at which fuel flows through the induction passage. For a carburetor of the present design, it has been experimentally found that the metering signal is approximately four times that on conventional carburetors for similar engine loads.

When air valve AV is closed, the vacuum created in the engine draws atmospheric air into passage 97 via passages 91, 93 and 95 and this flow of air modulates the metering signals otherwise created at the venturi by air flow into the engine through the respective carburetor induction passages. As a result, the quantity of fuel drawn into the respective inner induction passages is controlled to produce an air-fuel mixture whose air-fuel ratio is correct for the needs of the engine and is not overly rich as would occur if atmospheric air were not bled into the inner induction passages.

When air valve AV opens in the manner previously described, i.e. when staging occurs and the metering rods are withdrawn from their respective fuel circuit outlets, the enlarged diameter portion of each metering rod is drawn into its associated air passage 97 to block the flow of air to the venturi. The metering signal now produced at the venturi is no longer modulated and is a stronger signal than was present before the air valve opened. Thus, the desensitization of the fuel metering signal occurs only during a portion of carburetor operation. The result is more fuel being drawn into the respective inner induction passages after staging to enrich the resultant air-fuel mixture to meet the demands of the engine.

I claim:

1. A staged carburetor for an internal combustion engine comprising:

a carburetor body in which at least one pair of induction passages is formed for air to be drawn into said engine, said pair of induction passages including an inner induction passage having a venturi therewithin and an outer induction passage encircling said inner induction passage;

a throttle valve positioned at the outlet of said pair of induction passages and movable between a closed and an open position to control the flow of air through said induction passages;

at least one fuel circuit through which fuel is delivered from a source thereof to said inner induction passage, said fuel circuit having an outlet at said venturi;

a fuel metering rod extending transversely of said induction passages and having a variable diameter end portion projecting into said fuel circuit outlet, said metering rod being movable relative to said outlet to vary the quantity of fuel delivered and said metering rod having an enlarged diameter section intermediate its length which further reduces the cross-sectional area of said inner induction passage at said venturi and increases the pressure drop created thereat;

an air valve positioned in said outer induction passage and normally closing said passage whereby air is initially drawn into said engine only through said inner induction passage, an increased demand for air by said engine resulting in an opening force being exerted on said air valve to open it so air is drawn into said engine through both induction passages;

means linking said air valve to said metering rod to move said metering rod relative to said fuel circuit outlet as said air valve opens thereby to change the quantity of fuel drawn into said inner induction passage, the quantity of fuel delivered to said inner induction passage at any one time mixing with the air flowing through said pair of induction passages at that time to produce an air-fuel mixture combusted in said engine, and;

means for bleeding atmospheric air into said inner induction passage at said venturi to modulate the pressure drop created thereat and control the air-fuel ratio of the mixture produced in said induction passages.

2. A carburetor as set forth in claim 1 wherein said air bleed means includes an air passage communicating with the atmosphere and said inner induction passage and said metering rod is positioned in said air passage and is movable therein.

3. A carburetor as set forth in claim 2 wherein said air passage is cylindrical and said metering rod is axially aligned in said air passage.

4. A carburetor as set forth in claim 3 wherein said linking means comprises a rotatable counter shaft and a lever carried by said counter shaft, said lever contacting said metering rod to exert a force thereon to withdraw the variable diameter end portion of said metering rod out of said fuel circuit outlet when said counter shaft is rotated in one direction and to insert the variable diameter end portion of said metering rod into said fuel circuit outlet when said counter shaft is rotated in the opposite direction.

5. A carburetor as set forth in claim 4 wherein the enlarged diameter section of said metering rod is substantially equal to the diameter of said air passage and withdrawal of said metering rod from said fuel circuit outlet draws the enlarged diameter section thereof into said air passage thereby to substantially block said air passage.

6. A carburetor as set forth in claim 5 wherein said air valve is a split valve having first and second sections each respectively closing a portion of said outer induction passage, each section of said air valve being attached to a rotatable shaft and said linking means comprising means interconnecting said air valve shafts for simultaneously opening and closing both air valve sections.

7. A carburetor as set forth in claim 6 wherein said linking means comprises a first fixed lever rigidly mounted on one end of one of the air valve shafts, a second fixed lever rigidly mounted on the corresponding end of the other air valve shaft and a connecting rod connecting said first and second fixed levers to form a solid connection therebetween.

8. A carburetor as set forth in claim 7 wherein said linking means further comprises a third fixed lever rigidly mounted on the end of said counter shaft corresponding to the ends of said air valve shafts on which said first and second fixed levers are mounted and a second connecting rod connecting one of said first and second fixed levers to said third fixed lever whereby the opening movement of said air valve produces rotation of said counter shaft in the direction to withdraw the variable diameter end portion of said metering rod from said fuel circuit outlet and the closing movement of said air valve produces rotation of said counter shaft in the direction to insert the variable diameter end portion of said metering rod into said fuel circuit outlet.

9. A carburetor as set forth in claim 1 wherein said carburetor body has a second pair of induction passages formed therein, said second pair of induction passages including a second inner induction passage having a second venturi therewithin and a second outer induction passage encircling said second inner induction passage, a second fuel circuit through which fuel is delivered from a source thereof to said second inner induction passage, said second fuel circuit having an outlet at said second venturi, a second metering rod extending transversely of said second pair of induction passages and having a variable diameter end portion projecting into the outlet of said second fuel circuit, said second metering rod being movable relative to the outlet of said second fuel circuit to vary the quantity of fuel delivered to said second pair of induction passages and having an enlarged diameter section intermediate its length which further reduces the cross-sectional area of said second inner induction passage at said second venturi and increases the pressure drop thereat.

10. A carburetor as set forth in claim 9 wherein said air bleed means comprises first and second air passages each respectively communicating with the atmosphere and the respective inner induction passages, said metering rods being respectively positioned in said air passages and movable therewithin.

11. A carburetor as set forth in claim 10 wherein said air passages are cylindrical and said metering rods are respectively axially aligned in said air passages.

12. A carburetor as set forth in claim 11 wherein said linking means links said air valve to said second metering rod to move said second metering rod relative to said second fuel circuit outlet thereby to change the quantity of fuel drawn into said second inner induction passage.

13. A carburetor as set forth in claim 12 wherein said linking means includes means for simultaneously moving both metering rods relative to their respective fuel circuit outlets as said air valve opens.

14. A carburetor as set forth in claim 13 wherein said linking means comprises a rotatable counter shaft and a pair of levers carried by said counter shaft, one of said levers contacting the first said metering rod and the other lever contacting said second metering rod, both levers exerting a force on the respective metering rods to simultaneously withdraw the variable diameter end portion of said metering rods from the respective fuel circuit outlets when said counter shaft is rotated in one direction and to simultaneously insert the variable diameter end portion of the respective metering rods into the respective fuel circuit outlets when said counter shaft is rotated in the other direction.

15. A carburetor as set forth in claim 14 wherein the enlarged diameter section of each said metering rod is substantially equal to the diameters of the respective air passages and the withdrawal of said metering rods from their corresponding fuel circuit outlets draws the enlarged diameter sections thereof into said respective air passages therby to substantially block said air passages.

* * * * *